US006044501A

United States Patent [19]

Mihara

[11] Patent Number: 6,044,501

[45] Date of Patent: Apr. 4, 2000

[54] TEMPERATURE CONFIRMATION MECHANISM FOR USE WITH WATER SUPPLY EQUIPMENT

[76] Inventor: Kenji Mihara, c/o Mihara Co., Ltd. Urban-kit 3F, 4-11 Tachibana-dori Hagashi 1-Chome, Miyazaki-shi Miyazaki 880, Japan

[21] Appl. No.: 09/084,026

[22] Filed: May 22, 1998

Related U.S. Application Data

[63] Continuation-in-part of application No. 08/849,817, filed as application No. PCT/JP95/02079, Oct. 6, 1995.

[30] Foreign Application Priority Data

Jan. 25, 1995 [JP] Japan ..... 7/44709
May 22, 1997 [JP] Japan ..... 9-170876

[51] Int. Cl.[7] ..... A47K 3/22

[52] U.S. Cl. ..... 4/615; 4/567; 4/661; 138/114

[58] Field of Search ..... 138/104, 114, 138/117; 4/567, 615, 601, 661, 276, 280, 281, 282, 420.2, 443, 420.4, 448, 678; 239/581.1, 587.3; 137/312

[56] References Cited

U.S. PATENT DOCUMENTS 2,228,626 1/1941 Hetherington ..... 4/615
4,457,342 7/1984 Moen ..... 4/678
5,667,146 9/1997 Pimentel et al. ..... 4/615

*Primary Examiner*—David J. Walczak
*Assistant Examiner*—Tuan Nguyen
*Attorney, Agent, or Firm*—Sheridan Ross P.C.

[57] ABSTRACT

A temperature confirmation mechanism is disclosed for use with water supply equipment. The temperature confirmation mechanism allows a user to confirm the temperature of the water before causing water to spout from the water supply equipment. The temperature confirmation mechanism includes a conduit having a shallow portion formed around a conduit. A water supply communicates with the conduit to supply water to the water supply equipment. An enclosing member creates a chamber by enclosing the shallow portion around the conduit. Further, the enclosing member is rotatable around said shallow portion. A communication hole fluidly connects the conduit and the chamber. A temperature confirmation hole is provided in said enclosing member. As such, water exiting the temperature confirmation hole may be tested before the user spout water from the water supply equipment. In one embodiment, the diameter of the temperature confirmation hole is larger than the diameter of the communication hole.

11 Claims, 2 Drawing Sheets

2(a)

2(b)

2(a)

2(b)

TEMPERATURE CONFIRMATION MECHANISM FOR USE WITH WATER SUPPLY EQUIPMENT

REFERENCE TO RELATED APPLICATIONS

This application is a continuation in part of U.S. application Ser. No. 08/849,817 filed Jun. 16, 1997, which is a U.S. National Phase filing of PCT Application No. PCT/JP95/02079 filed Oct. 6, 1995 which is based on Japanese Application No. JP 95-44709. This application also claims priority under 35 U.S.C. §119 from JP 97-170876. All of the aforementioned applications are incorporated herein by reference in their entirety.

FIELD OF THE INVENTION

This invention is related to a temperature confirmation mechanism that can be fitted on water supply equipment, such as a shower spout or a faucet. The temperature confirmation mechanism has a temperature confirmation hole for testing the temperature of water supplied from the water supply equipment before spouting water from the shower spout or faucet.

BACKGROUND OF THE INVENTION

When using a shower spout or a faucet which is connected to a water supply source, water which is too hot may exit from the spout or faucet due to misoperation. Therefore, it is desirable to confirm the temperature of hot water before a large volume of water spouts from the faucet.

In the previous application (U.S. patent application Ser. No. 08/849,817), the temperature confirmation hole is provided on the water supply pipe of the shower spout or faucet. Fluid communication to the temperature confirmation hole is provided via a communicating pipe connected to a three-way valve. The communicating pipe has a narrow portion to restrict the flow amount. In this embodiment the three-way valve is connected between the water supply pipe and the shower spout or the faucet.

In the above mentioned application, the detailed structure of the temperature confirmation mechanism was not disclosed. This application is directed toward the novel structure of the temperature confirmation mechanism. Typically, the fitting used in connection with the temperature confirmation mechanism is dependent upon the design of the shower spout or faucet. Since there are many designs of shower spouts or faucets, it is difficult to find a fitting that can universally fit all designs. Additionally, in conventional temperature confirmation holes, water can spray from the hole when the water pressure is high or a pressure surge occurs.

SUMMARY OF THE INVENTION

The object of the present invention is to provide a temperature confirmation mechanism for water supply equipment. The temperature confirmation mechanism can be any type of water supply equipment, regardless of design. In operation, the present invention prevents hot water from spouting from the temperature confirmation hole when the water pressure is high or a pressure surge occurs.

Specifically, the temperature confirmation mechanism of the present invention includes a hollow portion that is formed around a pipe which communicates with water supply equipment. A closing part is provided which makes a chamber by tightly closing the hollow portion. The closing piece is able to rotate around the hollow portion. A communication hole communicates between inside of the pipe and the chamber. A temperature confirmation hole is positioned on said closing part.

In another embodiment, a temperature confirmation mechanism is provided for confirming the temperature of a fluid in a conduit which communicates with a water supply. The temperature confirmation mechanism includes a conduit having an inner diameter and a first outer diameter. The conduit has a central portion having a second outer diameter which is less than the first outer diameter. An enclosing member is provided for enclosing the central portion to create a chamber. The enclosing member is rotatable around the central portion. A communication hole is included for fluidly communicating between the conduit and the chamber. A temperature confirmation hole in the enclosing member.

In addition, one embodiment of the temperature confirmation mechanism may be provided for use with bathroom or shower equipment where water temperature confirmation is particularly important. Specifically, the temperature confirmation mechanism can be used in connection with a hand-held bidet, as described in U.S. application Ser. No. 08/849,817.

DETAILED DESCRIPTION

The temperature confirmation mechanism of the present invention includes a hollow portion formed, at least in part, around the peripheral surface of a pipe. A closing piece in the shape of a tube is provided. A temperature confirmation hole is positioned on the closing piece. The hollow portion is closed by the closing piece which forms a chamber around the pipe. A communication hole is provided to connect the inside of the pipe and the chamber.

The temperature confirmation hole is larger than the communication hole. As such, the water pressure from the temperature confirmation hole is reduced, since water exits the temperature confirmation hole only after water enters the chamber from the inside of the pipe. Therefore, hot water is prevented from spouting from the temperature confirmation hole when the water pressure is high or a water surge occurs.

The closing piece rotates around the chamber allowing the temperature confirmation hole to rotate. In addition, the temperature confirmation mechanism can be fitted on any design of the water supply equipment.

Also, a spout hose can be extended from the temperature confirmation hole to the hand of the user. The temperature confirmation mechanism may be connected to a two-way, three-way valve, or any other valve configuration. As such, regardless of the valve configuration, the temperature confirmation mechanism can be arranged to easily suit the user. Accordingly, the temperature of hot water can be confirmed before exiting from the shower spout or faucet.

Furthermore, the temperature confirmation mechanism may be applied to a branch pipe, such as a shower spout. In this configuration, the branch pipe is connected to the faucet from a main pipe. Accordingly, the temperature confirmation mechanism can be connected to the branch pipe. A two-way valve can be used to change the water route from the main pipe to the branch pipe.

EMBODIMENT 1

In this embodiment, a temperature confirmation mechanism is fitted to a branch pipe as a part of supply pipe. Further, the temperature confirmation mechanism is used to connect the branch pipe to a main pipe which supplies water.

Figure 1:
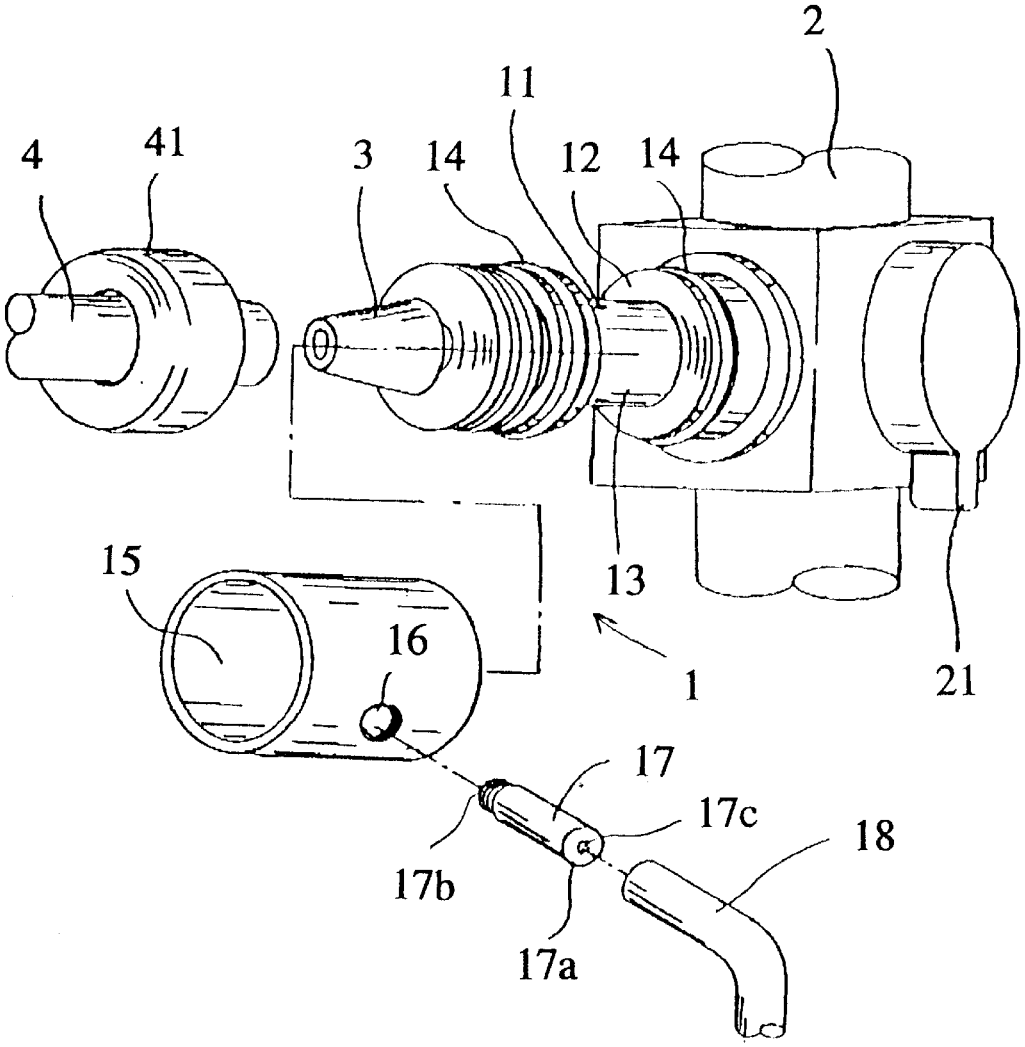
FIG. 1 is an exploded view perspective of the temperature confirmation mechanism of present invention.

As shown in FIG. 1, a temperature confirmation mechanism 1 is fitted as a part of a supply pipe 3. The supply pipe 3 is connected to a main pipe 2 which supplies hot water into a branch pipe 4. The water route is controlled by a valve 21.

The temperature confirmation mechanism 1 includes a hollow piece 12, in shape of a ring. The hollow piece 12 is formed around the periphery surface of the supply pipe 3. A closing tube 15 closes the hollow piece 12 to form chamber 13. As such, the hollow piece 12 enclosed and chamber 13 is formed around supply pipe 3 to the closing tube 15. A communicating hole 11 is provided to connect the inside of the supply pipe 3 and the chamber 13. A temperature confirmation port 16 is formed in a side-wall of the closing tube 15. Hot water exits from a chamber 13 via the confirmation port 16.

A spout pipe 17 having a spout port 17*c* is connected to the temperature confirmation port 16. Specifically, a first end 17*b* of spout pipe 17 is connected to the temperature confirmation port 16. A second end 17*a* of spout pipe 17 may be connected to an extended hose 18. In a preferred embodiment, the spout pipe 17 is connected to the temperature confirmation port 16 via a threaded connection. As such, the first end 17*b* of spout pipe 17 is threadily engaged into the temperature confirmation port 16 such that a portion of the first end 17*b* of the spout pipe 17 protrudes into the chamber 13. This protrusion of the first end 17*b* of the spout pipe 17 into the chamber 13 ensures that the closing tube 15 is not separated from the supply pipe 3 because the protrusion from the first end 17*b* will make contact with an edge of hollow piece 12. Thus, the closing tube 15 cannot be removed from the supply pipe 3 when the first end 17*b* is protruding into the chamber 13.

The diameters of the temperature confirmation port 16 and spout port 17*c* are formed larger than the diameter of the communicating hole 11. Typically, a diameter of the confirmation port 16 is several times, for example 100% to 500%, larger than the communicating hole 11. In one embodiment, the spout port 17*c* has a diameter that is about 10% to about 75% larger than the diameter of the communicating hole 11. More preferably, the spout port 17*c* would have a diameter that is about 15% to about 60% larger than the diameter of the communicating hole 17*c*, and most preferably the spout port 17*c* would have a diameter that is about 25% to about 50% larger than the diameter of the communicating hole 11.

As shown in FIG. 1, for the assembly of the temperature confirmation mechanism 1, the supply pipe 3 is inserted into the closing tube 15, such that the closing tube 15 is positioned wherein both O-rings 14 contact an inside wall of closing tube 15. As such, the hollow piece 12 is enclosed and the chamber 13 is formed between the supply pipe 3 and the closing tube 15. The spout pipe 17 is connected to the temperature confirmation port 16 such that the first end 17*b* protrudes into the chamber 13 and secures the closing tube 15 on the supply pipe 3. The spout pipe can be positioned at a desired angle because the closing tube 15 is freely rotatable around supply pipe 3. A branch pipe 4 can be connected to the supply pipe 3 and secured with cap 41, further securing closing tube 15 around the supply pipe 3.

Figure 2:
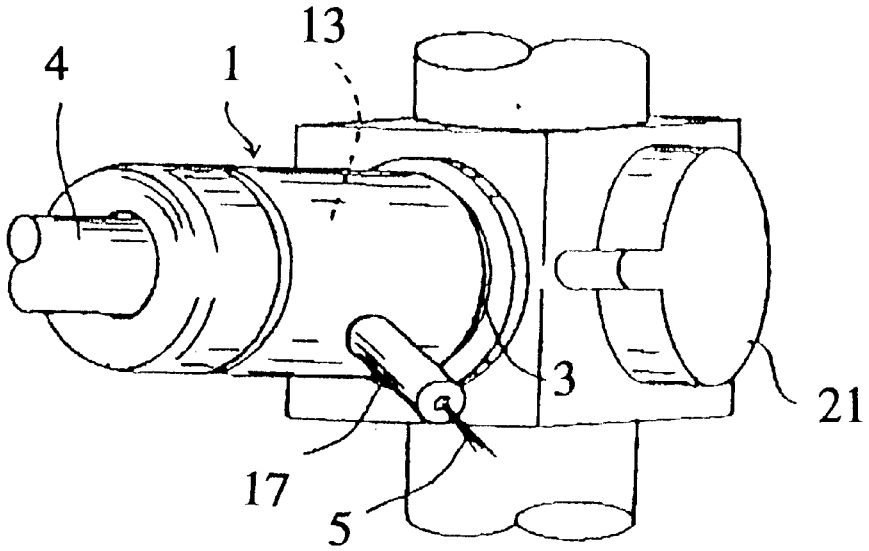
FIG. 2*a* is a perspective view showing detailed operation of the temperature confirmation mechanism.
FIG. 2*b* is a perspective view showing detailed operation of the temperature confirmation mechanism.
Figure 2:
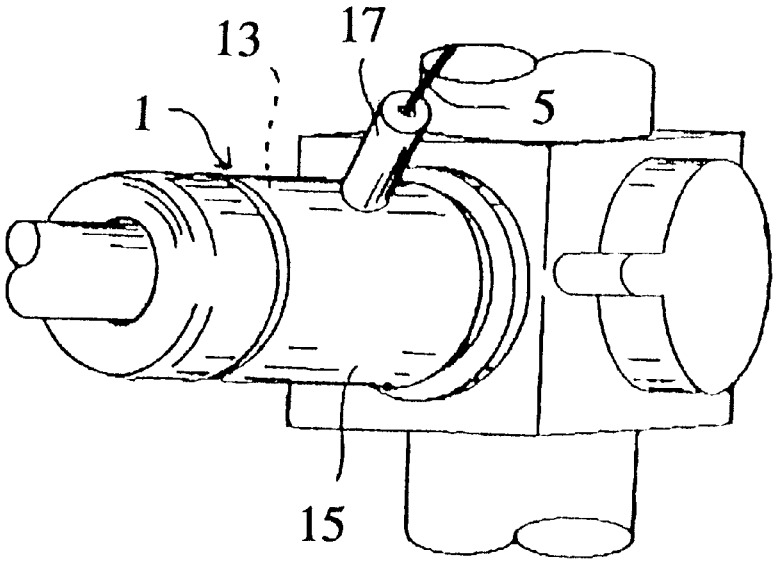

As shown in FIG. 2(*a*), when the water route is opened to the branch pipe 4 via valve 21, hot water 5 is supplied to supply pipe 3. The hot water 5 flows via the communicating hole 11 into the chamber 13. After the chamber 13 is filled, water exits from the spout pipe 17. Since water is supplied to the spout exit 17*a* via chamber 13, the water pressure of water exiting spout exit 17*a* is less than the water pressure in the supply pipe 3 because the size of temperature confirmation port 16 is larger than the size of the communicating hole 11. Accordingly, even at high water pressures or during a pressure surge in supply pipe 3, water 5 will never suddenly spout from spout exit 17*a* due to the pressure difference.

As shown in FIG. 2(*a*), the closing tube 15 can freely rotate around the chamber 13 (360 degrees) while maintaining tight seal around chamber 13. As such, the spout pipe 17 can be turned to any direction. Therefore, the most suitable direction of the spout pipe 17 can be selected by a user based on the type of water supply equipment in use, and the extended hose 18 can then be connected to the spout pipe 17.

In addition to the aforementioned advantages, the temperature confirmation mechanism 1 provides notification to the user that the valve 21 is positioned to supply water to the supply pipe 3. In some water delivery devices, release of water may be actuated by a mechanism at the terminal portion of the device, such as a press button actuator for release of water from a bidet handle. In this instance, when a user turns on the faucet and the valve 21 is positioned to supply water to the supply pipe 3, water will spout from the temperature confirmation port 16 even if water is not being released from the handle. This spouting of the water notifies the user that water is being supplied to the supply pipe 3.

Also, in some water supply systems, the temperature of the supply pipe 3 and water in the pipe 3 rises when hot water is supplied and a valve on the branch pipe 4 is continuously closed, thus, preventing a water flow. Under these circumstances, the temperature confirmation mechanism 1 prevents a drastic temperature increase in the supply pipe 3 water in the supply pipe 3 because the supply pipe 3 is never completely closed. In this regard, the temperature confirmation port 16 always allows a flow of water to exit from the supply pipe 3, thus, preventing the aforementioned temperature increase.

The foregoing discussion of the invention has been presented for purposes of illustration and description. Further, the description is not intended to limit the invention to the form disclosed herein. Consequently, variation and modification commensurate with the above teachings, within the skill and knowledge of the relevant art, are within the scope of the present invention. The embodiment described herein and above is further intended to explain the best mode presently known of practicing the invention and to enable others skilled in the art to utilize the invention as such, or in other embodiments, and with the various modifications required by their particular application or uses of the invention. It is intended that the appended claims be construed to include alternative embodiments to the extent permitted by the prior art.

What is claimed is:

1. A temperature confirmation mechanism comprising:

an enclosing member;

a temperature confirmation hole having a first diameter, said temperature confirmation hole located in said enclosing member;

a fluid conduit connected to a water supply wherein at least a portion of said fluid conduit is located within said enclosing member to form a chamber in communication with said temperature confirmation hole, wherein said conduit comprises: a longitudinal axis, a first end connected to said water supply, a second end having an outlet opening in a plane perpendicular to said longitudinal axis, said outlet opening connected to a branch pipe, and a communication hole having a second diameter located in said fluid conduit, wherein said communication hole is in communication with said chamber, and wherein said first diameter is larger than said second diameter, and wherein said enclosing member is rotatably mounted around said fluid conduit.

2. The temperature confirmation mechanism, as claimed in claim 1, wherein said temperature confirmation hole communicates with a spout pipe.

3. The temperature confirmation mechanism, as claimed in claim 1, further comprising a seal located between said enclosing member and said fluid conduit.

4. The temperature confirmation mechanism, as claimed in claim 1, wherein said temperature confirmation hole further comprises:

a connector for threadibly attaching a hose to said temperature confirmation hole.

5. The temperature confirmation mechanism, as claimed in claim 1, wherein said fluid conduit further comprises:

a valve connected between said first end and said water supply.

6. The temperature confirmation mechanism, as claimed in claim 5, wherein said valve is connected to a branch of said water supply.

7. A temperature confirmation mechanism for confirming the temperature of a fluid in a conduit which communicates with a water supply, said temperature confirmation mechanism comprising:

a conduit having an inner diameter and a first outer diameter wherein said conduit has a central portion having a second outer diameter and a longitudinal axis, wherein said second outer diameter is less than said first outer diameter, wherein a first end of said conduit is in communication with said water supply and a second end of said conduit has an outlet opening in a plane perpendicular to said longitudinal axis and delivers the fluid to at least one of a spout, a faucet, a bidet and a shower head connected thereto;

an enclosing member for enclosing said central portion to create a chamber wherein said enclosing member is rotatable around said central portion;

a communication hole for fluidly communicating between said conduit and said chamber; and a temperature confirmation hole in said enclosing member, wherein a flow of water from said temperature confirmation hole to an exterior of said enclosing member is enabled.

8. The temperature confirmation mechanism, as claimed in claim 7, wherein a diameter of said communication hole is smaller than a diameter of said temperature confirmation hole.

9. The temperature confirmation mechanism, as claimed in claim 7, wherein said second end of said conduit comprises a spout.

10. The temperature confirmation mechanism, as claimed in claim 7, wherein said second end of said conduit is threaded for attaching a branch pipe to said conduit.

11. The temperature confirmation mechanism, as claimed in claim 7, wherein a valve is interposed between said first end of said conduit and said second end of said conduit for controlling a flow of the fluid through said conduit.

* * * * *